US010876547B2

(12) United States Patent
Castan et al.

(10) Patent No.: US 10,876,547 B2
(45) Date of Patent: Dec. 29, 2020

(54) COMPRESSOR WHEEL AND SHAFT ASSEMBLY

(71) Applicant: Garrett Transportation I Inc., Torrance, CA (US)

(72) Inventors: Joel Castan, Chantraine (FR); Dominique Armand, Uxegney (FR); Gerard Dieudonne, Les Forges (FR); Raphael Hettinger, La Baffe (FR); Alain Claudon, Oncourt (FR); Bernard Remy, Epinal (FR)

(73) Assignee: Garrett Transportation I Inc., Torrance, CA (US)

( * ) Notice: Subject to any disclaimer, the term of this patent is extended or adjusted under 35 U.S.C. 154(b) by 762 days.

(21) Appl. No.: 15/258,520

(22) Filed: Sep. 7, 2016

(65) Prior Publication Data

US 2018/0066676 A1 Mar. 8, 2018

(51) Int. Cl.

| | |
|---|---|
| ***F04D 29/62*** | (2006.01) |
| ***F04D 29/26*** | (2006.01) |
| ***F01D 5/02*** | (2006.01) |
| ***F04D 25/04*** | (2006.01) |
| ***F04D 25/06*** | (2006.01) |
| ***F04D 29/054*** | (2006.01) |
| ***F04D 29/28*** | (2006.01) |
| ***F04D 29/42*** | (2006.01) |
| ***F04D 25/02*** | (2006.01) |

(52) U.S. Cl.

CPC ..... *F04D 29/624* (2013.01); *F01D 5/025* (2013.01); *F04D 25/045* (2013.01); *F04D 25/06* (2013.01); *F04D 29/054* (2013.01); *F04D 29/266* (2013.01); *F04D 29/284* (2013.01); *F04D 29/4206* (2013.01); *F04D 25/024* (2013.01); *F05D 2220/40* (2013.01); *F05D 2260/31* (2013.01)

(58) Field of Classification Search

CPC .. F04D 29/624; F04D 29/266; F04D 29/4206; F04D 29/284; F04D 29/053; F04D 25/06; F04D 25/045

See application file for complete search history.

(56) References Cited

U.S. PATENT DOCUMENTS 3,061,342 A * 10/1962 Feller ..... F01D 5/025 403/15
4,915,589 A * 4/1990 Gessler ..... F01D 5/025 415/217.1
9,709,067 B2 * 7/2017 Chekansky ..... F01D 25/16
(Continued)

FOREIGN PATENT DOCUMENTS

DE 10 2010 010136 A1 9/2011
DE 10 2015 106638 A1 1/2016

OTHER PUBLICATIONS

TEXTRON Fastening Systems, TORX(R) Drive System, 2001 (8 pages).
EPO Application No. 17187379.7-1007, Extended European Search Report dated Jan. 23, 2018 (8 pages).

*Primary Examiner* — Kenneth J Hansen
*Assistant Examiner* — Jason Fountain
(74) *Attorney, Agent, or Firm* — Brian J. Pangrle

(57) ABSTRACT

An assembly can include a shaft that includes threads and a free end that includes a shaft drive feature; a compressor wheel that includes a compressor wheel drive feature and a through bore that receives the shaft; and a nut that includes threads that mate the threads of the shaft.

20 Claims, 11 Drawing Sheets

(56) References Cited

U.S. PATENT DOCUMENTS

| | | | | |
|---|---|---|---|---|
| 2004/0131469 | A1* | 7/2004 | Billington | F04D 29/266<br>416/204 R |
| 2015/0318750 | A1 | 11/2015 | Thompson et al. | |
| 2016/0215787 | A1 | 7/2016 | Hall | |

* cited by examiner

COMPRESSOR WHEEL AND SHAFT ASSEMBLY

TECHNICAL FIELD

Subject matter disclosed herein relates generally to compressor wheel and shaft assemblies for internal combustion engines.

BACKGROUND

A turbocharger can include a rotating group that includes a turbine wheel and a compressor wheel that are connected to one another by a shaft. For example, a turbine wheel can be welded or otherwise connected to a shaft to form a shaft and wheel assembly (SWA) and a compressor wheel can be fit to the free end of the shaft. An electric compressor can include one or more compressor wheels that are connected to a shaft or shafts that can be driven by an electric motor. As an example, a shaft that is attached to one or more bladed wheels may be supported by one or more bearings disposed in a bearing housing, which may form a center housing rotating assembly (CHRA). During operation of a turbocharger or an electric compressor, depending on factors such as size of various components, a shaft may be expected to rotate at speeds in excess of 200,000 rpm. To ensure proper rotordynamic performance, a rotating group should be well balanced and well supported over a wide range of conditions (e.g., operational, temperature, pressure, etc.).

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with examples shown in the accompanying drawings where.

DETAILED DESCRIPTION

Below, an example of a turbocharged engine system is described followed by various examples of components, assemblies, methods, etc.

Figure 1:
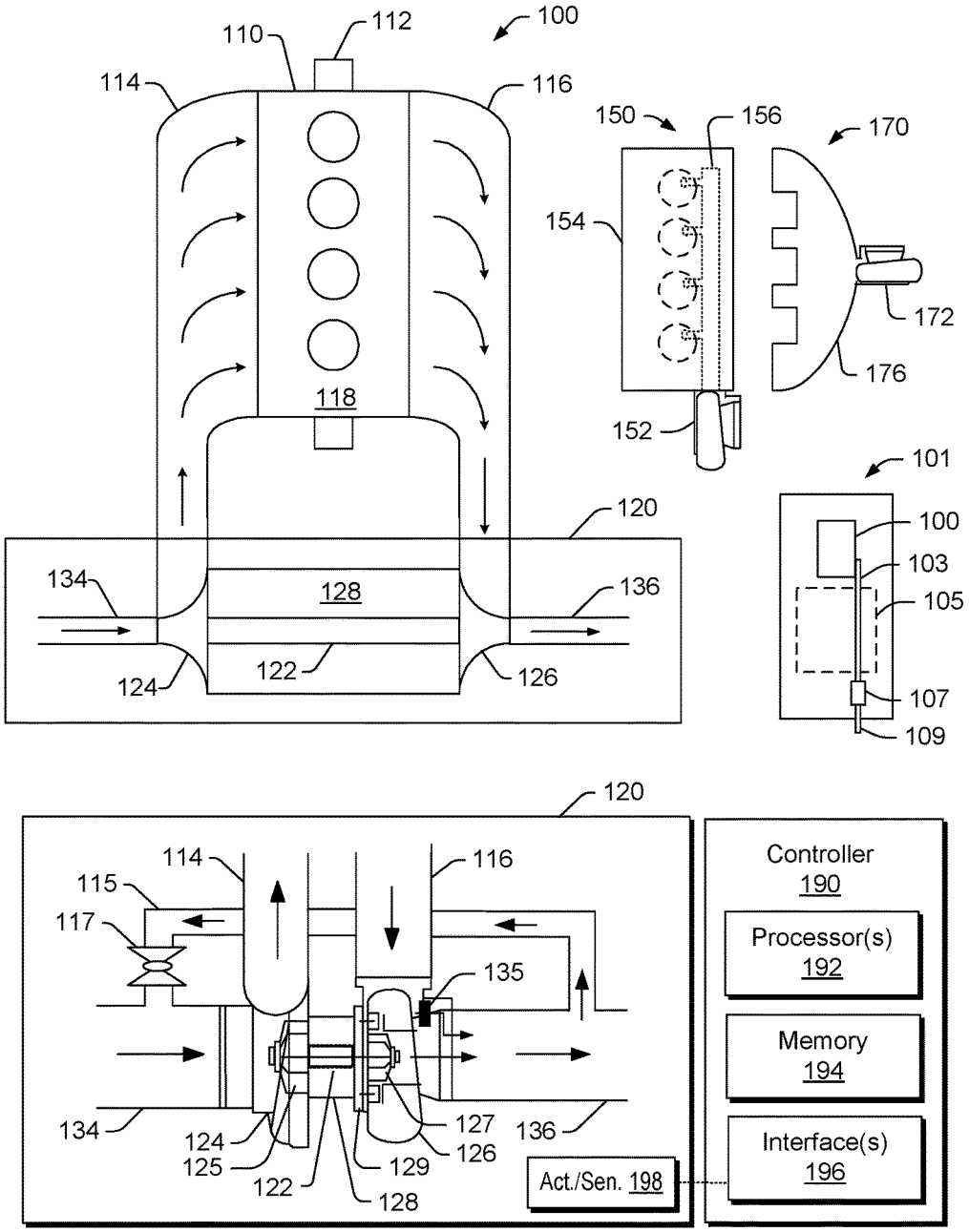
FIG. 1 is a diagram of a turbocharger and an internal combustion engine along with a controller.

Turbochargers are frequently utilized to increase output of an internal combustion engine. Referring to FIG. 1, as an example, a system 100 can include an internal combustion engine 110 and a turbocharger 120. As shown in FIG. 1, the system 100 may be part of a vehicle 101 where the system 100 is disposed in an engine compartment and connected to an exhaust conduit 103 that directs exhaust to an exhaust outlet 109, for example, located behind a passenger compartment 105. In the example of FIG. 1, a treatment unit 107 may be provided to treat exhaust (e.g., to reduce emissions via catalytic conversion of molecules, etc.).

As shown in FIG. 1, the internal combustion engine 110 includes an engine block 118 housing one or more combustion chambers that operatively drive a shaft 112 (e.g., via pistons) as well as an intake port 114 that provides a flow path for air to the engine block 118 and an exhaust port 116 that provides a flow path for exhaust from the engine block 118.

The turbocharger 120 can act to extract energy from the exhaust and to provide energy to intake air, which may be combined with fuel to form combustion gas. As shown in FIG. 1, the turbocharger 120 includes an air inlet 134, a shaft 122, a compressor housing assembly 124 for a compressor wheel 125, a turbine housing assembly 126 for a turbine wheel 127, another housing assembly 128 and an exhaust outlet 136. The housing assembly 128 may be referred to as a center housing assembly as it is disposed between the compressor housing assembly 124 and the turbine housing assembly 126.

In FIG. 1, the shaft 122 may be a shaft assembly that includes a variety of components (e.g., consider a shaft and wheel assembly (SWA) where the turbine wheel 127 is welded to the shaft 122, etc.). As an example, the shaft 122 may be rotatably supported by a bearing system (e.g., journal bearing(s), rolling element bearing(s), etc.) disposed in the housing assembly 128 (e.g., in a bore defined by one or more bore walls) such that rotation of the turbine wheel 127 causes rotation of the compressor wheel 125 (e.g., as rotatably coupled by the shaft 122). As an example a center housing rotating assembly (CHRA) can include the compressor wheel 125, the turbine wheel 127, the shaft 122, the housing assembly 128 and various other components (e.g., a compressor side plate disposed at an axial location between the compressor wheel 125 and the housing assembly 128).

In the example of FIG. 1, a variable geometry assembly 129 is shown as being, in part, disposed between the housing assembly 128 and the housing assembly 126. Such a variable geometry assembly may include vanes or other components to vary geometry of passages that lead to a turbine wheel space in the turbine housing assembly 126. As an example, a variable geometry compressor assembly may be provided.

In the example of FIG. 1, a wastegate valve (or simply wastegate) 135 is positioned proximate to an exhaust inlet of the turbine housing assembly 126. The wastegate valve 135 can be controlled to allow at least some exhaust from the exhaust port 116 to bypass the turbine wheel 127. Various wastegates, wastegate components, etc., may be applied to a conventional fixed nozzle turbine, a fixed-vaned nozzle turbine, a variable nozzle turbine, a twin scroll turbocharger, etc. As an example, a wastegate may be an internal wastegate (e.g., at least partially internal to a turbine housing). As an example, a wastegate may be an external wastegate (e.g., operatively coupled to a conduit in fluid communication with a turbine housing).

In the example of FIG. 1, an exhaust gas recirculation (EGR) conduit 115 is also shown, which may be provided, optionally with one or more valves 117, for example, to allow exhaust to flow to a position upstream the compressor wheel 125.

FIG. 1 also shows an example arrangement 150 for flow of exhaust to an exhaust turbine housing assembly 152 and another example arrangement 170 for flow of exhaust to an exhaust turbine housing assembly 172. In the arrangement 150, a cylinder head 154 includes passages 156 within to direct exhaust from cylinders to the turbine housing assembly 152 while in the arrangement 170, a manifold 176 provides for mounting of the turbine housing assembly 172, for example, without any separate, intermediate length of exhaust piping. In the example arrangements 150 and 170, the turbine housing assemblies 152 and 172 may be configured for use with a wastegate, variable geometry assembly, etc.

In FIG. 1, an example of a controller 190 is shown as including one or more processors 192, memory 194 and one or more interfaces 196. Such a controller may include circuitry such as circuitry of an engine control unit (ECU). As described herein, various methods or techniques may optionally be implemented in conjunction with a controller, for example, through control logic. Control logic may depend on one or more engine operating conditions (e.g., turbo rpm, engine rpm, temperature, load, lubricant, cooling, etc.). For example, sensors may transmit information to the controller 190 via the one or more interfaces 196. Control logic may rely on such information and, in turn, the controller 190 may output control signals to control engine operation. The controller 190 may be configured to control lubricant flow, temperature, a variable geometry assembly (e.g., variable geometry compressor or turbine), a wastegate (e.g., via an actuator), an electric motor, or one or more other components associated with an engine, a turbocharger (or turbochargers), etc. As an example, the turbocharger 120 may include one or more actuators and/or one or more sensors 198 that may be, for example, coupled to an interface or interfaces 196 of the controller 190. As an example, the wastegate 135 may be controlled by a controller that includes an actuator responsive to an electrical signal, a pressure signal, etc. As an example, an actuator for a wastegate may be a mechanical actuator, for example, that may operate without a need for electrical power (e.g., consider a mechanical actuator configured to respond to a pressure signal supplied via a conduit).

Figure 2:
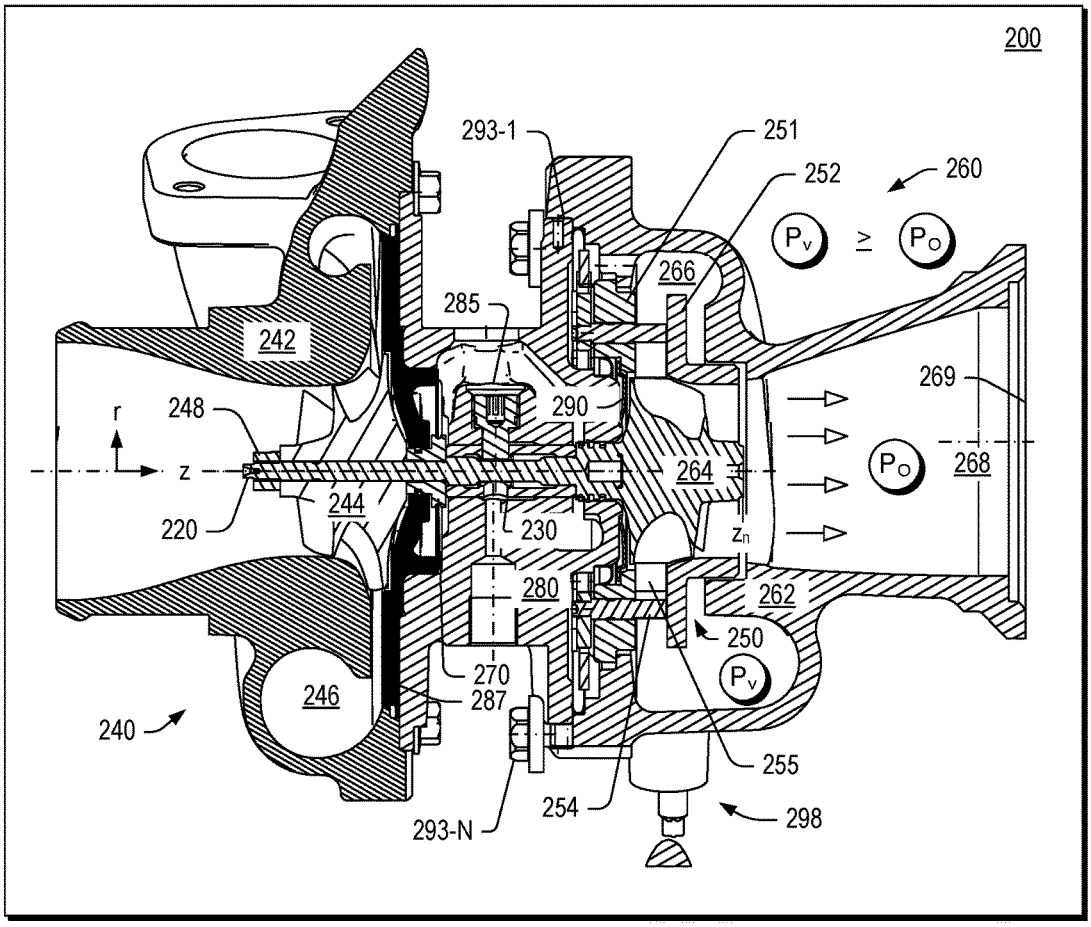
FIG. 2 is a cutaway view of an example of a turbocharger assembly.

FIG. 2 shows an example of a turbocharger assembly 200 that includes a shaft 220 supported by a bearing 230 (e.g., a journal bearing, a bearing assembly such as a rolling element bearing with an outer race, etc.) disposed in a bore (e.g., a through bore defined by one or more bore walls) of a housing 280 between a compressor assembly 240 and a turbine assembly 260.

In the example of FIG. 2, the bearing 230 is shown as a journal bearing that includes an opening that receives a locating pin 285 that can axially and/or azimuthally locate the journal bearing while allowing for some amount of radial movement (e.g., up and down), which may allow for a lubricant film to form and vary in thickness in a space between an outer surface of the journal bearing and a wall surface of a through bore of the housing 280. Such an arrangement can allow for some amount of damping as to vibration, etc. as well as heat transfer as lubricant flows through passages of the housing 280 from a lubricant inlet (lower side) to a lubricant outlet (upper side) where the lubricant pin 285 may be accessible via the lubricant outlet (e.g., for insertion, rotation, etc.).

In the example of FIG. 2, the bearing 230 is disposed about the shaft 220 axially between the compressor assembly 240 and the turbine assembly. As shown, a portion of the shaft 220 is disposed in a bore of the bearing 230 where journal surfaces of the shaft 220 mate with journal surfaces of the bearing 230 and where clearances exist between the journal surfaces to allow for flow of lubricant and lubricant film formation.

In the example of FIG. 2, the compressor assembly 240 includes a compressor housing 242 that defines a volute 246 and that houses a compressor wheel 244. As shown in FIG. 2, the turbine assembly 260 includes a turbine housing 262 that defines a volute 266 and that houses a turbine wheel 264. The turbine wheel 264 may be, for example, welded or otherwise attached to the shaft 220 to form a shaft and wheel assembly (SWA) where a free end of the shaft 220 allows for attachment of the compressor wheel 244. For example, in FIG. 2, a nut 248 is shown as being attached to the shaft 220 where rotation of the nut 248 with respect to threads of the shaft 220 causes a compressive force to be applied to the compressor wheel 244 between a nose and a base of the compressor wheel 244 where a thrust collar 270 is disposed at least in part axially between the base of the compressor wheel 244 and an axial face of the shaft 220, which may be formed as an axial face of a shoulder of the shaft 220. As the nut 248 is tightened, a portion of the shaft 220 (e.g., between the axial face of the shaft 220 and the nut 248) can be placed in tension. During operation, rotation of the shaft 220 results in rotation of the compressor wheel 244 such that the turbine wheel 264, the shaft 220 and the compressor wheel 244 rotate as a unit (e.g., at a common rpm).

In the example of FIG. 2, a section of the shaft 220 that helps to maintain the compressor wheel 244 can be a pilot section, which may be referred to as a pilot. For example, an axial length of the shaft 220 can include one or more surfaces that can contact one or more surfaces of a bore of the compressor wheel 244. As an example, the shaft 220 can include one or more pilot surfaces over an axial length of the shaft 220.

As shown in the example of FIG. 2, a backplate 287 can be fit between the compressor housing 242 and the housing 280. For example, the backplate 287 can be seated in part in a recess of the compressor housing 242 and seated in part in a recess of the housing 280. As shown, the backplate 287 includes an opening that receives a portion of the thrust collar 270. In such an example, a seal element (e.g., a piston ring, etc.) can be set in an annular grove of the thrust collar 270 and help to form a seal with respect to the backplate 287. As shown, axial clearance can exist between the base of the compressor wheel 244 and a portion of the thrust collar 270. As an example, the thrust collar 270 can include one or more slinging features that can sling lubricant radially outwardly, which may help to hinder migration of lubricant from the housing 280 to a compressor wheel space of the compressor assembly. As shown, the backplate 287 can define a diffuser section with respect to a surface of the compressor housing 242 where gas compressed via rotation of the compressor wheel 244 can be directed toward the volute 246.

The turbine assembly 260 further includes a variable geometry assembly 250, which may be referred to as a "cartridge" (e.g., the cartridge 250), that may be positioned using an annular component or flange 251 (e.g., optionally shaped as a stepped annular disc) of the cartridge 250 that clamps between the housing 280 and the turbine housing 262, for example, using bolts 293-1 to 293-N and a heat shield 290 (e.g., optionally shaped as a stepped annular disc), the latter of which is disposed between the cartridge 250 and the housing 280. As shown in the example of FIG. 2, the cartridge 250 includes a shroud component 252 and the annular component 251. As an example, one or more mounts or spacers 254 may be disposed between the shroud component 252 and the annular component 251, for example, to axially space the shroud component 252 and the annular component 251 (e.g., forming a nozzle space).

As an example, vanes 255 may be positioned between the shroud component 252 and the annular component 251, for example, where a control mechanism may cause pivoting of the vanes 255. As an example, the vane 255 may include a vane post that extends axially to operatively couple to a control mechanism, for example, for pivoting of the vane 255 about a pivot axis defined by the vane post.

As an example, each vane may include a vane post operatively coupled to a control mechanism. In the example of FIG. 2, a clearance exists between an upper surface of the vane 255 and a lower surface of the shroud component 252. As mentioned, deformation of the shroud component 252 may diminish such clearance and, for example, have an effect on vane control. In the example of FIG. 2, a clearance can exist between a lower surface of the vane 255 and an upper surface of the annular component 251. As an example, deformation of the shroud component 252 may also diminish such clearance and, for example, have an effect on vane control. For example, to move vanes, a greater force may be required from a controller. In such an example, a controller may be sized to overcome such force, which, in turn, may increase cost, increase energy consumption, decrease available compartment space, etc.

As an example, a surface of a vane post may define a clearance with respect to a surface of a vane post bore of the annular component 251. In such an example, one or more forces may act to diminish the clearance such that contact occurs between the surfaces, which may increase demand on a controller. In such an example, a controller may be sized to overcome such force, which, in turn, may increase cost, increase energy consumption, decrease available compartment space, etc.

As to exhaust flow, higher pressure exhaust in the volute 266 passes through passages (e.g., a nozzle or nozzles, a throat or throats, etc.) of the cartridge 250 to reach the turbine wheel 264 as disposed in a turbine wheel space defined by the cartridge 250 and the turbine housing 262. After passing through the turbine wheel space, exhaust travels axially outwardly along a passage 268 defined by a wall of the turbine housing 262 that also defines an opening 269 (e.g., an exhaust outlet). As indicated, during operation of the turbocharger 200, exhaust pressure in the volute 266 ($P_V$) is greater than the exhaust pressure in the passage 268 ($P_O$).

As shown in FIG. 2, the turbine wheel 264 can include an inducer portion and an exducer portion, for example, characterized in part by an inducer radius (n) and an exducer radius ($r_e$). As an example, an individual blade can include an inducer edge (e.g., a leading edge) and an exducer edge (e.g., a trailing edge) where an inducer edge may be oriented in a substantially axial direction and where an exducer edge may be oriented in a substantially radial direction. An inducer diameter, as may be defined by inducer edges, can exceed an exducer diameter, as may be defined by exducer edges. A turbine wheel may be defined in part by a trim value that characterizes a relationship between inducer and exducer portions.

In the example of FIG. 2, the SWA includes a larger diameter shaft portion at the turbine wheel 264, which may be at a diameter that is approximately equal to or greater than an outer diameter of the bearing 230. As an example, an axial clearance can exist between a turbine end of the bearing 230 and the larger diameter shaft portion and an axial clearance can exist between a compressor end of the bearing 230 and the thrust collar 270. In such an example, the SWA, the thrust collar 270 and the compressor wheel 244 may move axially, for example, responsive to thrust forces that may be generated during operation of the turbocharger assembly 200. As mentioned, the bearing 230 may be located by the locating pin 285 as received via an opening in the housing 280. Where thrust forces are transferred to the bearing 230, the locating pin 285 may come into contact with the bearing 230, which can limit axial movement of the shaft 220, the thrust collar 270, the compressor wheel 244 and the turbine wheel 264.

As mentioned, the compressor wheel 244 can be fit to the shaft 220 via use of the nut 248. A process that attaches the compressor wheel 244 to the shaft 220 may be referred to as a clamping and tightening process. In such a process, a process variable or process parameter may be the amount of torque transmitted through the shaft; noting that torque can be transmitted via the turbine wheel.

As an example, torque applied to tighten can be divided in the following two manners: (a) underhead torque that causes compressor wheel rotation during tightening; and (b) thread torque as transmitted through a pilot portion or pilot section of a shaft. As an example, applied torque can generate torsional stresses and may limit the clamping load in a joint.

Figure 3:
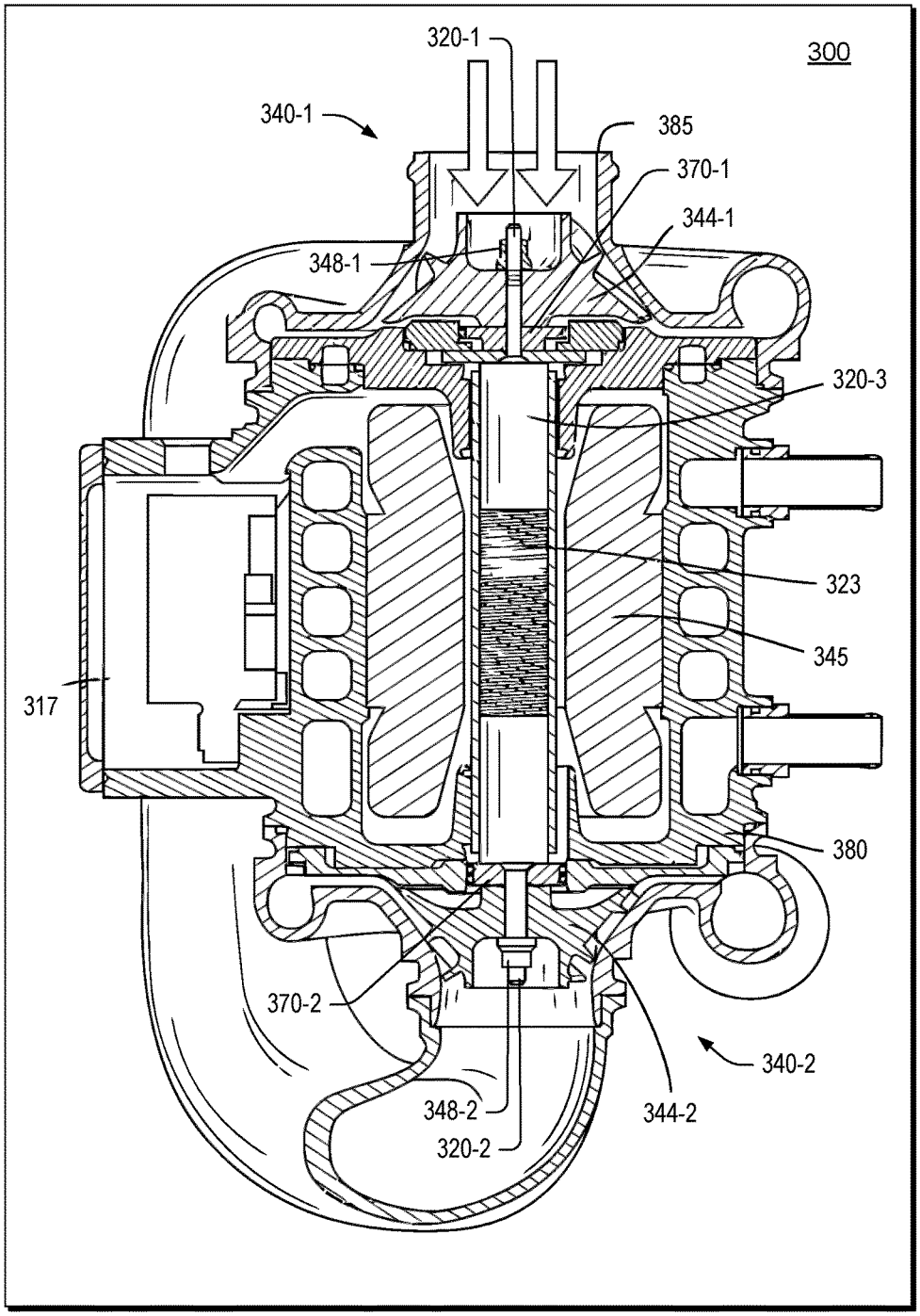
FIG. 3 is a cutaway view of an example of an electric compressor assembly.

FIG. 3 shows an approximate cross-sectional view of a dual-stage motor-driven compressor 300, which may be, for example, utilized with one or more batteries, fuel cells, generators, etc. In the example of FIG. 3, the dual-stage motor-driven compressor 300 may include a low pressure side compressor 340-1 and a high pressure side compressor 340-2 at respective ends of the compressor. The low pressure side compressor 340-1 can include a compressor wheel 344-1 that draws in fluid (e.g., air, air-exhaust and/or air-fuel) through an inlet 385, which may be at approximately atmospheric pressure and temperature. As the compressor wheel 344-1 is rotated, the blades of the compressor wheel compress the air (e.g., or air mixture) to a first pressure above atmospheric pressure. This low pressure fluid is then routed to the high pressure side compressor 340-2 of the dual-stage motor-driven compressor 300, where another compressor wheel 344-2 further compresses the fluid to a higher second pressure above atmospheric pressure. This high pressure air may be to an internal combustion engine, a cathode side of a fuel cell (e.g., to provide oxygen for the fuel cell reaction to produce electricity), etc.

As shown in FIG. 3, the compressor wheels 344-1 and 344-2 may be attached to respective shafts 320-1 and 320-2, which may be attached to a shaft or rotor 320-3 that is supported within a housing 380. In the case of a motor-driven dual-stage compressor, the shaft 320-3 may include a section having one or more magnet(s) 323 within or wrapped around the shaft 320-3 that, in cooperation with a motor stator 345, drives the shaft 320-3. In this regard, the motor stator 345 may be opposingly disposed with respect to the shaft 320-3 (e.g., spaced from and surrounding the shaft 320-3) such that an electric current (e.g., from a suitable energy source or sources) can rotate the shaft 320-3 and the compressor wheels 344-1 and 344-2 to compress fluid.

As an example, electricity may be supplied to the motor stator 345 via a terminal block assembly 317 that is configured to provide electrical connections between a source (e.g., via controller cables) and the motor stator 345 (e.g., via motor stator cables).

In the example of FIG. 3, the compressor wheel 344-1 includes a nut 348-1 and the compressor wheel 344-2 includes a nut 348-2. The nut 348-1 is shown as being attached to the shaft 320-1 where rotation of the nut 348-1 with respect to threads of the shaft 320-1 causes a compressive force to be applied to the compressor wheel 344-1 between a nose and a base of the compressor wheel 344-1 where a thrust collar 370-1 (e.g., optionally a multi-piece thrust collar assembly) is disposed at least in part axially between the base of the compressor wheel 344-1 and an axial face of the shaft 320-1 and/or the shaft 320-3, which may be formed as an axial face of a shoulder of the shaft 320-1 and/or the shaft 320-3. As the nut 348-1 is tightened, a portion of the shaft 320-1 (e.g., between the axial face and the nut 348-1) can be placed in tension. During operation, rotation of the shaft 320-1 results in rotation of the compressor wheel 344-1 such that the shaft 320-1 and the compressor wheel 344-1 rotate as a unit (e.g., at a common rpm).

In the example of FIG. 3, a section of the shaft 320-1 that maintains the compressor wheel 344-1 can be a pilot section, which may be referred to as a pilot. For example, an axial length of the shaft 320-1 can include one or more surfaces that can contact one or more surfaces of a bore of the compressor wheel 344-1. As an example, the shaft 320-1 can include one or more pilot surfaces over an axial length of the shaft 320-1.

As an example, a compressor wheel can include a recessed nose. For example, the compressor wheel 344-1 includes a recessed nose surface disposed about an opening of a through bore where the nut 348-1 can contact the recessed nose surface. As an example, one or more tools may be configured to be inserted into a nose recess to contact the nut 348-1.

While the example of FIG. 3 shows two compressor wheels driven by a motor, as an example, an electric compressor may include a single compressor wheel and shaft assembly. As an example, an electric compressor that includes one or more compressor wheels and one or more associated shaft may include one or more of the compressor wheel and shaft assembly features, for example, as described with respect to FIG. 4, etc.

Figure 4:
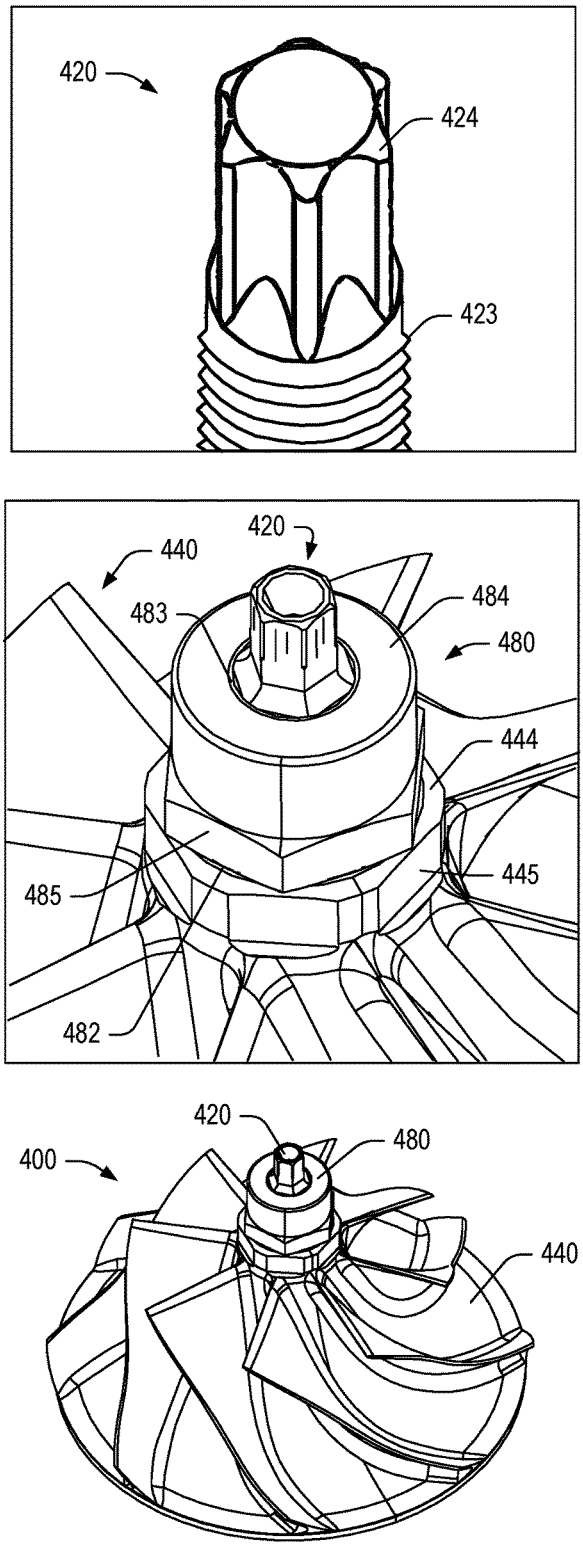
FIG. 4 shows a series of perspective view of an example of a portion of an assembly.

FIG. 4 shows an example of a portion of an assembly 400 that includes a shaft 420, a compressor wheel 440 and a nut 480. As shown in the example of FIG. 4, the shaft 420 includes threads 423 and a TORX® head 424 (Textron Inc., Rockford, Ill.), the compressor wheel 440 includes a hexagonal flats 445 and the nut 480 includes a threaded bore 483 and hexagonal flats 485. Such features allow for performing a clamping and tightening method that attaches the compressor wheel 440 to the shaft 420.

In the example of FIG. 4, by adding the TORX® head 424 on the shaft 420 (e.g., or another rotation lock system on the shaft 420), a method can include maintaining the shaft and limiting its exposure to parasitic torsions. In such an example, thread torque can be reduced (e.g., substantially eliminated) in the pilot area (e.g., pilot portion or pilot section). For example, if a device (e.g., a tool) stops rotation of a compressor wheel, the underhead friction torque can be supported by that device. As an example, tensile loads can be applied in a shaft pilot area (e.g., substantially only tensile loads). As an example, parasitic torsion can be present in a non-used area of a shaft (TORX® head) and can be released at the end of tightening.

With a device on a shaft (e.g., a shaft head), a rotor can be stilled from rotating during tightening. As an example, a compressor wheel can be blocked in its rotation. As an example, two types of torques generated by a screwing operation can be blocked. As an example, a shaft pilot can be substantially free of the torsional effect of tightening where a shaft head includes a feature (e.g., TORX®, etc.). In such an example, kinematics of screwing can become more repeatable from part-to-part in a mass production operation. As an example, a method can include alleviating parasitic torsion in a shaft during a clamping and tightening process. For example, during a method of assembly, torsion may exist in a head portion of a shaft where such torsion can be released upon assembly.

As an example, a method can include applying preload to a compressor wheel with a nut and at the same time preventing compressor wheel rotation and twisting of a shaft (e.g., a portion of the shaft that passes through a bore of the compressor wheel). As an example, with respect to the example of FIG. 4, such a method can include three tools, one for the TORX® head 424 of the shaft 420, one for the hexagonal flats 445 of the compressor wheel 440 and one for the hexagonal flats 485 of the nut 480.

As shown in the example of FIG. 4, the nut 480 can include a lower surface 482 and an upper surface 484 where the bore 483 extends from the lower surface 482 to the upper surface 484. In such an example, at least a portion of the bore 483 includes threads that can mate with threads 423 of the shaft 420 as disposed a distance from the TORX® head 424 of the shaft 420. As shown in the example of FIG. 4, the compressor wheel 440 can include an upper surface 444 where the lower surface 482 of the nut 480 may be brought into contact with the upper surface 444 of the compressor wheel 424. As an example, the diameters of the flats 445 and the flats 485 may be the same or they may differ. For example, the flats 485 may be of a lesser diameter than the flats 445 of the compressor wheel 440 (e.g., a diameter measured by a hexagon inscribed in a circle, etc.).

As shown in the example of FIG. 4, the TORX® head 424, in an assembled state, can extend axially past the upper surface 484 of the nut 480. As an example, a tool may be fit to the TORX® head 424 from a side and/or from an axial end of the shaft 420. As an example, a tool may be fit to the flats 485 from a side and/or from an axial end of the nut 480. As an example, a tool may be fit to the flats 445 from a side and/or from an axial end of the compressor wheel 440. As an example, a tool assembly may include one or more of the aforementioned tools.

As mentioned, where a process includes turning a nut via a first tool while preventing a turbine wheel from rotation via a second tool that contacts the turbine wheel, a seating torque may be generated that prevents release of the nut until the tension is loose; and a thread torque may be generated. Further, tension in an assembly (e.g., linked to helicoidally shape pitch and diameter) can be generated. Yet further, torsional constraints of a bolt can exist. In such a process, an axial load is applied.

As an example, consider a CHRA with an approximately 50 mm compressor wheel where average torques applied are as follows via a process that includes contacting a turbine wheel of a SWA with a tool while tightening a nut that contacts a compressor wheel: Total Torque of about 5 Nm; Seating Torque of about 2 Nm; and Thread Torque of about 3 Nm. In such an example, consider an axial load of about 5600 N. In such an example, the thread torque is supported by the stub shaft and can result in about 5 degrees torsion.

The foregoing torques increase stress levels. As an example, a reduction in torsion stress may allow for use of a larger sized compressor wheel.

As an example, a method that includes using a tool to prevent rotation of a compressor wheel may result in no substantial residual torque of an assembly and, for example, may provide for counter torque on a shaft and a compressor wheel.

As an example, an assembly can include a shaft with a drive feature (e.g., TORX® head, hexagon, etc.); a compressor wheel with a drive feature (e.g., hexagon flats, other type of flats, etc.); and a nut with a drive feature (e.g., hexagon flats, other type of flats, etc.).

As an example, a tool assembly for performing a method can include holding and drive tools. For example, consider a holding tool for a compressor wheel drive feature, a drive and holding tool for a shaft feature (e.g., at an end of a SWA such as a head, a tip, etc.) and a drive tool for a nut feature.

As an example, a method can allow for utilization of a larger range for bearing systems, can allow for a decrease in assembly unbalance, can allow for making two assemblies non-dependent together, and can allow for compressor wheel tightening where access to another side may not be available.

As an example, a shaft can include a head feature for driving (e.g., rotation) and holding (e.g., rotation lock). As an example, a nut can include a drive feature for driving (e.g., rotation). As an example, a compressor wheel can include a hold feature for holding (e.g., rotation lock).

As an example, a method can include limiting parasitic torsion transferred to a portion of a shaft. For example, a method can include limiting torsion to an end portion of a shaft that includes a head feature and where the shaft includes threads proximate to the head feature where a nut can be threaded onto the shaft via the threads. As an example, a compressor wheel may be held via a feature to prevent the compressor wheel from rotating while threads of a nut and shaft are mated to bring the nut in contact with the compressor wheel (e.g., direct or indirect) to apply force to the compressor wheel.

As an example, a method can prevent rotation of a compressor wheel such that underhead friction torque is supported. As an example, a method can provide for generation of tensile loads in a shaft pilot area. As an example, a method can limit parasitic torsion to be present in the non-used area of a shaft (e.g., a head portion of the shaft) where such torsion can be released at the end of tightening.

As an example, a method can include engaging features via tools where one tool prevents a compressor wheel from rotating while another tool rotates and tightens a nut on a shaft where yet another tool prevents the shaft from twisting while the nut is being tightened (e.g., against the compressor wheel).

Figure 5:
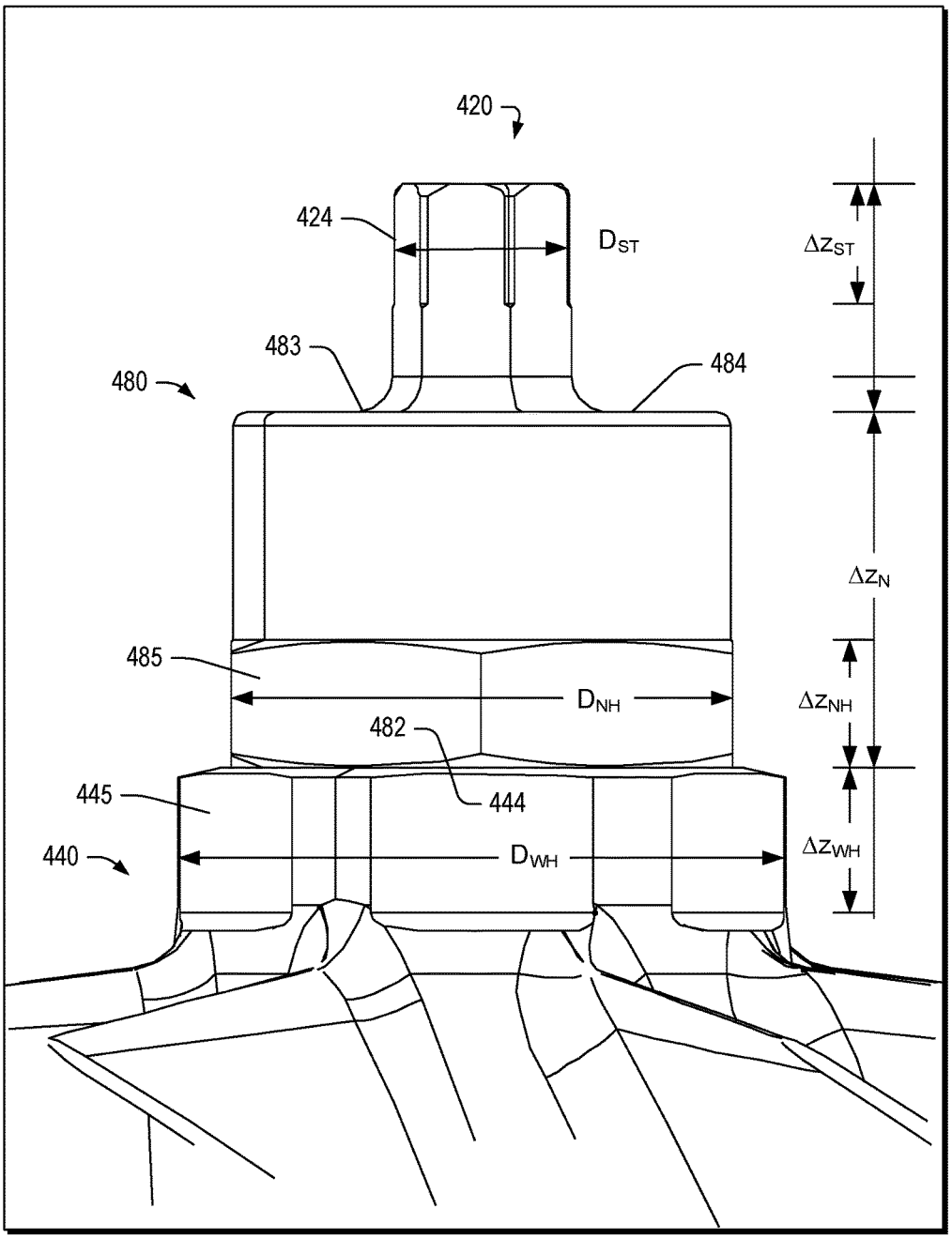
FIG. 5 shows a side view of a portion of the assembly of FIG. 4.

FIG. 5 shows a side view of a portion of the assembly 400 of FIG. 4. As shown, the shaft 420 includes a head portion 424 with an axial length and a diameter, the nut 480 includes the flats 485 with an axial length and a diameter, and the compressor wheel 440 includes the flats 445 with an axial length and a diameter.

Figure 6:
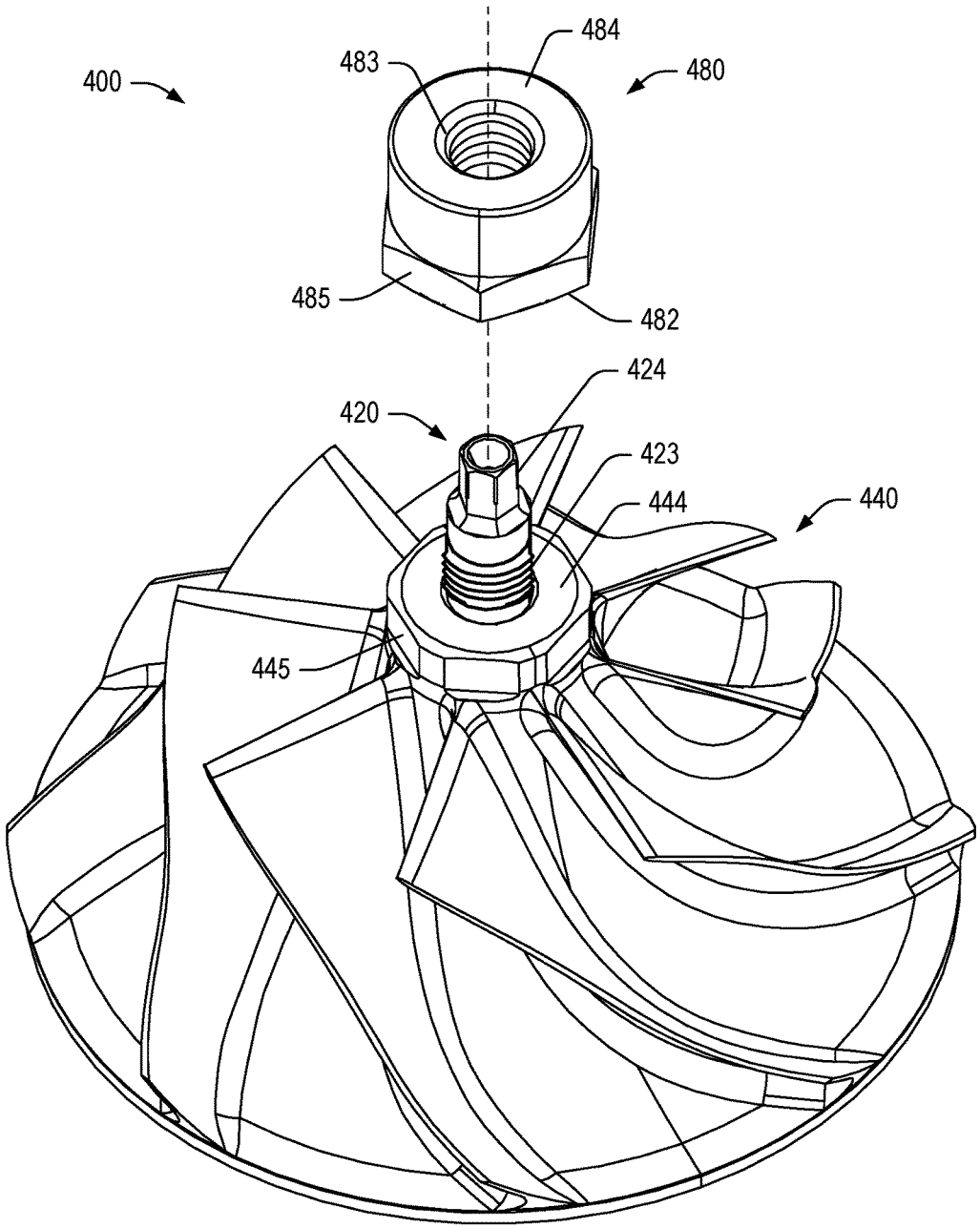
FIG. 6 shows an exploded perspective view of the portion of the assembly of FIG. 4.

FIG. 6 shows an exploded perspective view of the assembly 400 where the nut 480 is removed from the shaft 420. As shown, the threaded bore 483 of the nut 480 can mate with the threads 423 of the shaft 420. In such an example, a tool may grasp the flats 445 of the compressor wheel 440, a tool may grasp the flats 485 of the nut 480 and a tool may grasp the head portion 424 of the shaft 420. In such an example, the tool that grasps the flats 485 of the nut 480 may rotate the nut 480 to contact the surfaces 482 and 444 while the two other tools prevent rotation of the compressor wheel 440 and the shaft 420, respectively.

Figure 7:
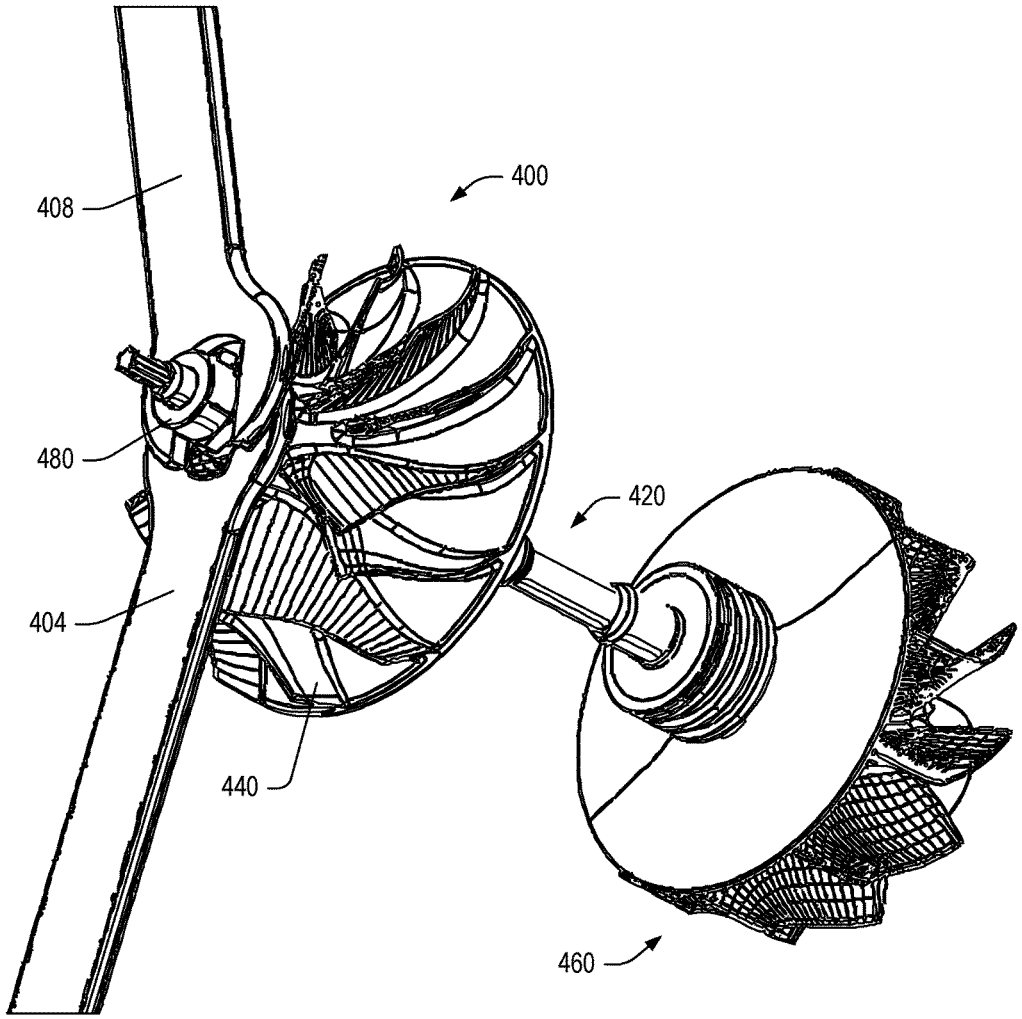
FIG. 7 shows a perspective view of an example of a portion of an assembly and examples of tools.

FIG. 7 shows an example of two tools 404 and 408, which may be wrenches or other types of tools that engage the flats 445 of the compressor wheel 440 and the flats 485 of the nut 480. In such an example, a third tool may be fit to the head portion of the shaft 420. As shown, the shaft 420 is part of an SWA that includes a turbine wheel 460. The example of FIG. 7 is shown without the housing; noting that such a process can be performed to assembly a CHRA.

Figure 8:
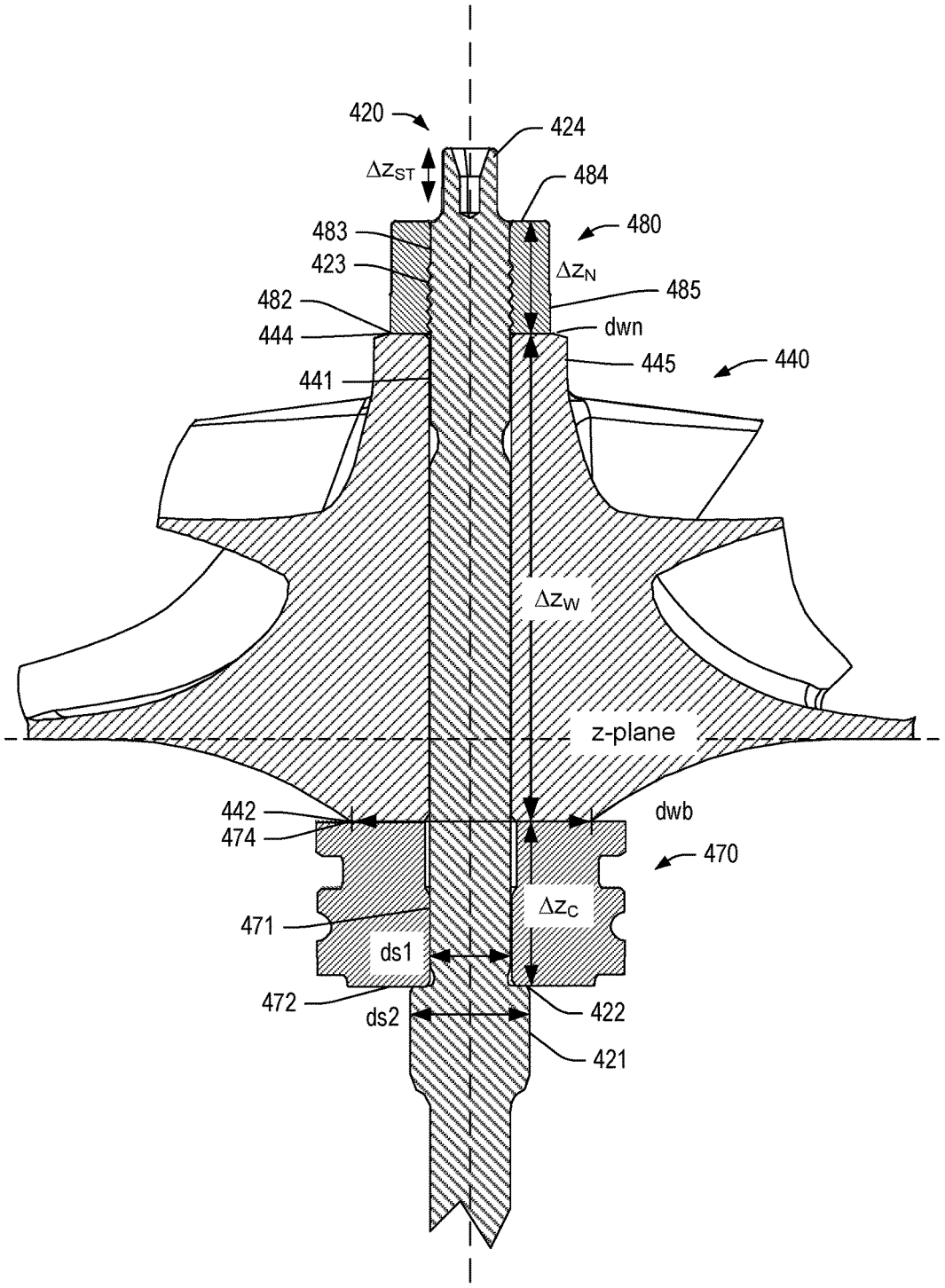
FIG. 8 shows a cross-sectional view of a portion of an example of an assembly.

FIG. 8 shows a cross-sectional view of a portion of the shaft 420, the compressor wheel 440, the thrust collar 470 and the nut 480. As shown, the thrust collar 470 includes an upper surface 474 and a lower surface 472 where the upper surface 474 abuts the base 442 of the compressor wheel 440 and where the lower surface 472 abuts an axial face 422 of the shaft 420, which may be an axial face of a shoulder 421 of the shaft 420. As shown, the shaft 420 includes a pilot portion that is disposed in a through bore 441 of the compressor wheel 440 that extends from the base 442 to the nose surface 444.

Various axial dimensions are illustrated in FIG. 8 as well as a contact diameter between the base 442 of the compressor wheel 440 and the upper surface 474 of the thrust collar 470. For example, $\Delta z_N$ represents an axial length of the nut 480, $\Delta z_{ST}$ represents a drive feature axial length of the shaft 420 (e.g., a male and/or a female dimension or dimensions), $\Delta z_W$ represents an axial length of the compressor wheel 440, $\Delta z_C$ represents an axial length of the collar 470, z-plane represents a z-plane of the compressor wheel 440, ds1 represents a diameter of the shaft 420, ds2 represents a diameter of the shaft 420 that is larger than the diameter ds1 where the collar 470 can include a through bore 471 with a through bore diameter of about ds1 and where the compressor wheel 440 can include a through bore diameter of about ds1 of the through bore 441. Also shown are dimensions dwn and dwb, which are a diameter of the compressor wheel 440 at the nose and a diameter of the compressor wheel at the base, respectively. As an example, the collar 470 can include a first axial face that abuts the base of the compressor wheel 440 and a second axial face that abuts, at least in part, a face of the shaft 420 (e.g., an annular axial face of a shoulder of the shaft 420). As an example, a shaft 420 can be a stepped shaft where a journal surface for a bearing at a corresponding diameter steps to a smaller diameter (see, e.g., ds1 and ds2).

As mentioned, a portion of the shaft 420 that is disposed in the through bore 441 of the compressor wheel 440 can be a pilot portion, which may include one or more diameters where a portion includes a diameter that is approximately the same as a diameter of the through bore 441 over an axial length such that the pilot portion can help to locate the compressor wheel 440 (e.g., align a longitudinal center axis (e.g., rotational axis) of the compressor wheel 440 with a longitudinal center axis (e.g., rotational axis) of the shaft 420).

As an example, drive features of the shaft 420, the compressor wheel 440 and the nut 480 can be male drive features. As an example, drive features of the shaft 420, the compressor wheel 440 and the nut 480 may include one or more female drive features. As an example, drive features of the shaft 420, the compressor wheel 440 and the nut 480 include at least one male drive feature and at least one female drive feature.

In the example of FIG. 8, the nut 480 can be tightened against the compressor wheel 440 such that the portion of the shaft 420 between the axial face 422 of the shaft 420 and the threads 423 of the shaft 420 is placed in tension, for example, with minimal to no twisting (e.g., torsion). For example, where the compressor wheel 440 and the shaft 420 are held while the nut 480 is tightened, torsion as to the aforementioned portion of the shaft 420 may be reduced (e.g., minimized to a low to nil level). In such an example, during tightening of the nut 480, torsion may exist in an end portion of the shaft 420 (e.g., shaft head 424); however, that torsion may be released after or upon assembly (e.g., reaching a desired load, etc.).

Figure 9:
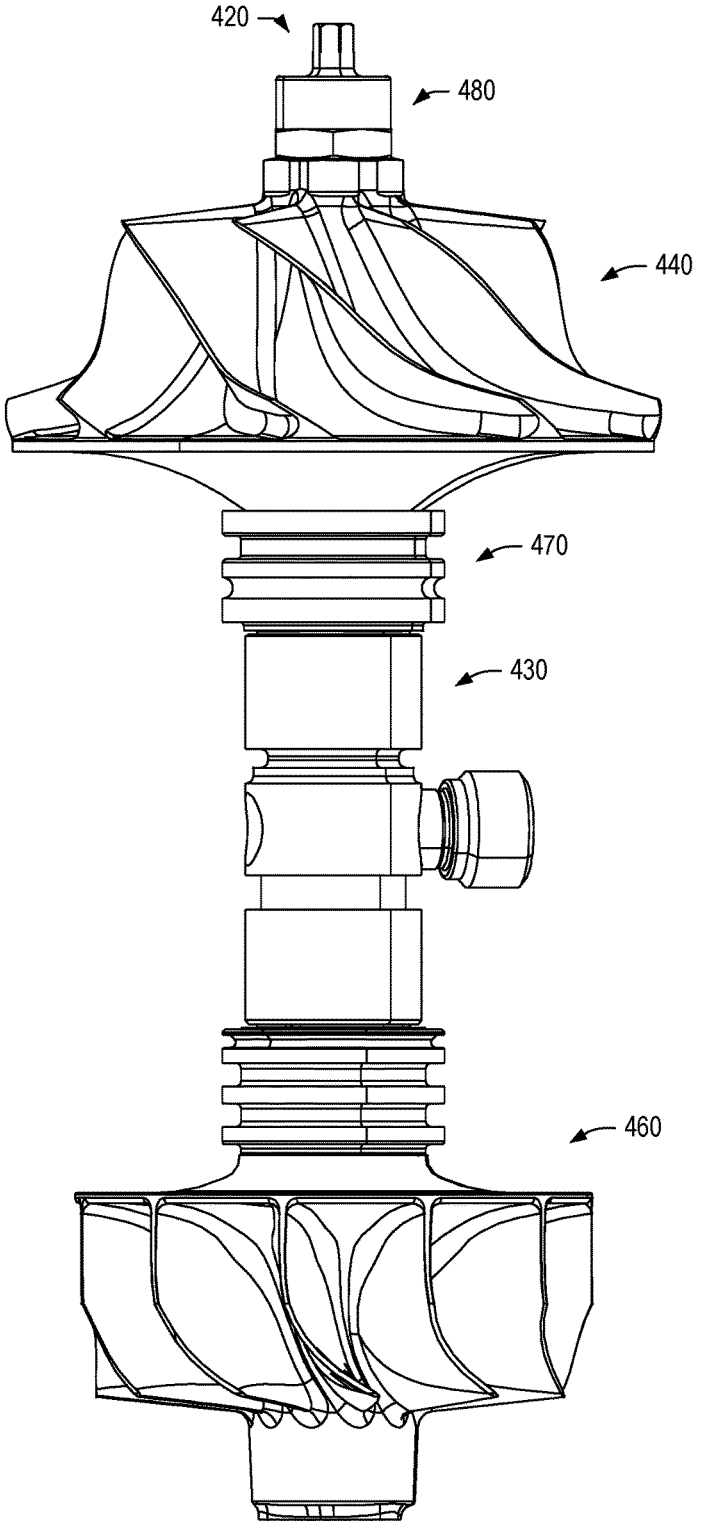
FIG. 9 shows a side view of an example of a portion of an assembly.

FIG. 9 shows an example of an assembly that includes the shaft 420, a bearing 430, the compressor wheel 440, the thrust collar 470 and the nut 480. Such an assembly may be part of a CHRA, which may be part of a turbocharger assembly (see, e.g., the turbocharger assembly 200 of FIG. 2). As an example, an assembly can include a shaft and a compressor wheel where the shaft is driven by an electric motor (see, e.g., the assembly 300 of FIG. 3). As an example, an assembly can include one or more shafts and one or more compressor wheels where the one or more shafts are driven by an electric motor or electric motors (see, e.g., the assembly 300 of FIG. 3).

Figure 10:
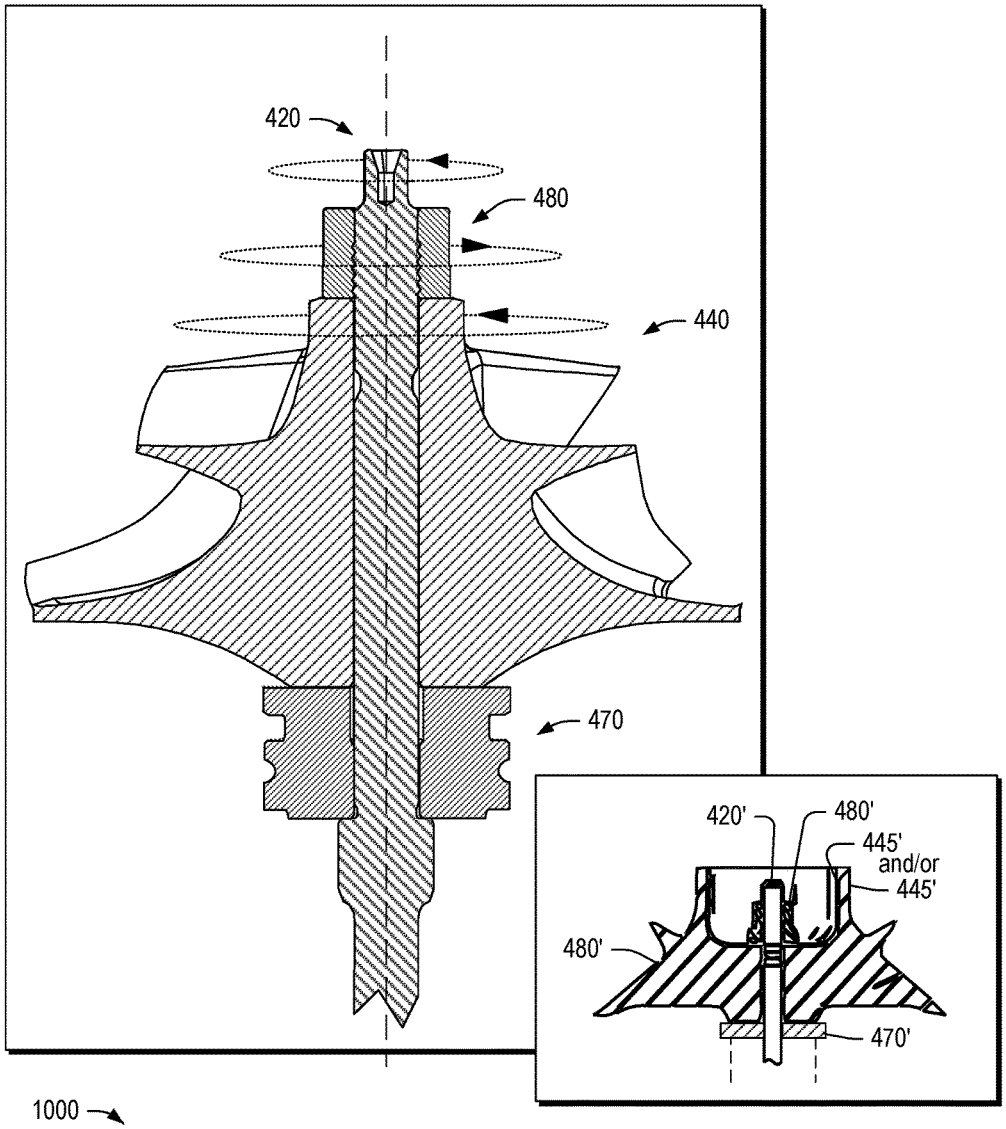
FIG. 10 shows the cross-sectional view of the portion of the example of an assembly of FIG. 8 and a block diagram of an example of a method.
Figure 10:
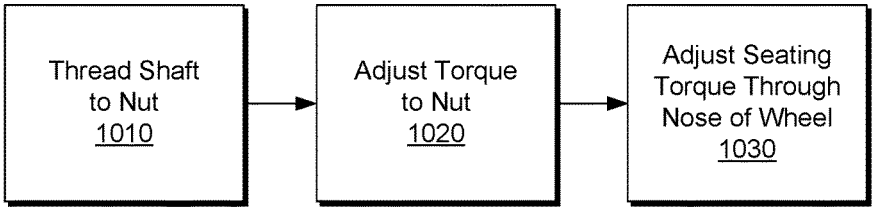

FIG. 10 shows the cross-sectional view of the assembly of FIG. 8 and a cross-sectional view of an example of another assembly that includes a compressor wheel 480' with a recessed nose along with a block diagram of a method 1000 that includes a thread block 1010 for threading the shaft to the nut, an adjust block 1020 to torque the nut and an adjust block 1030 that adjusts seating torque through nose of a compressor wheel. For example, a head portion of the shaft 420 may be rotated to thread the nut 480 to a desired preliminary position (e.g., via a tool) where torque of the nut 480 can be adjusted (e.g., via a tool) while adjusting seating torque of the nut 480 with respect to the compressor wheel 440 via a nose feature (e.g., flats) of the compressor wheel 440 (e.g., as engaged by a tool or tools).

In FIG. 10, the compressor wheel 480' with the recessed nose can include one or more drive features 445' (e.g., exterior to the recesss and/or interior to the recess). Also shown are a shaft 420', a nut 480' and a collar 470'. As an example, an inner portion (e.g., within the recess) can include one or more drive features and/or an outer portion can include one or more drive features. In such an example, one or more tools may be utilized to engage one or more drive features of a compressor wheel that includes, for example, a recessed nose. As an example, a tool may be a socket tool that can be inserted into a nose recess of a compressor wheel with a recessed nose. As an example, a socket tool may include a bore through which a tool can be positioned to engage a drive feature of a shaft. As an example, tools may be assembled in a nested fashion where a tool engages a drive feature of a shaft, a tool engages a drive feature of a nut and a tool engages a drive feature of a compressor wheel. As an example, such tools may be utilized to perform a method such as the method 1000 of FIG. 10.

Figure 11:
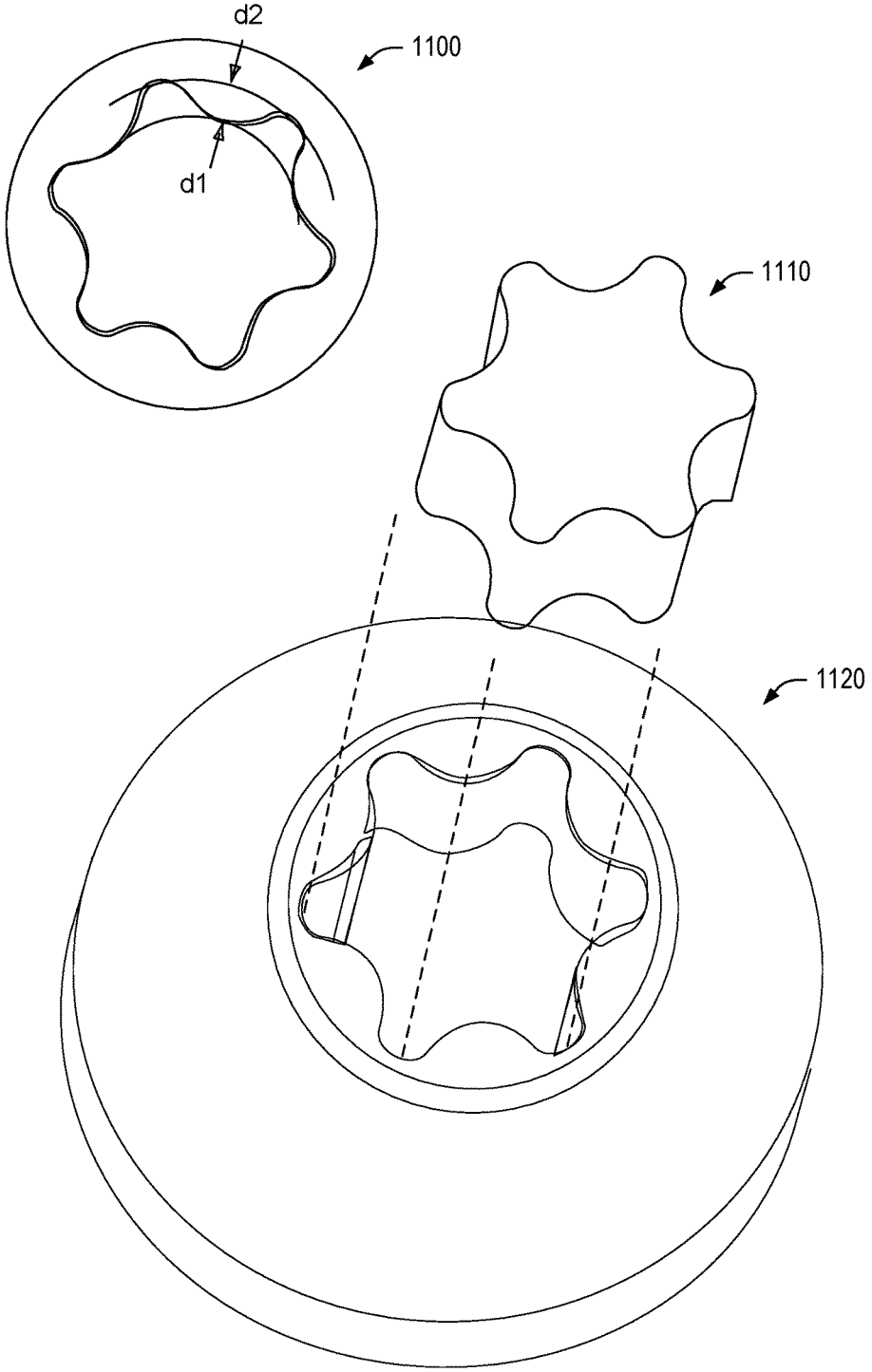
FIG. 11 shows examples of drive features.

FIG. 11 shows examples of drive features including a TORX® drive feature diagram 1100, a male feature 1110 and a female feature 1120. As an example, a shaft can include a male feature and/or a female feature. As an example, a tool can include a male feature and/or a female feature. As to TORX® drive features, consider, for example, a dimension specified with a "T" indicator such as T5=1.42 mm, T6=0.9 mm, T10=2.74 mm, T15=3.27 mm, T30=5.52 mm, etc. As an example, a dimension may be selected with a corresponding torque given in Nm (e.g., T5=0.51 Nm, T10=4.5 Nm, T15=7.7 Nm, T20=12.7 Nm, etc.). As an example, a male feature of a shaft may correspond to a male TORX® feature and/or a female feature of a shaft may correspond to a female TORX® feature.

As an example, a size of a feature and whether a feature is male or female may be determined in part by torque and size of a shaft. For example, where a shaft size is relatively small for a desired torque level, a male feature may be utilized (e.g., formed along exterior surface of the shaft).

As an example, a compressor wheel and shaft assembly can include a tightening torque that is in a range from about 2 Nm to about 8 Nm. In such an example, a drive feature of a shaft can be selected that is based on a margin above the tightening torque (e.g., about 1.1 or more). For example, where a tightening torque is about 6 Nm, a T15 size may provide for 7.7 Nm, which is greater than about 6.6 Nm (e.g., 6 Nm*1.1). In such an example, the T15 size (3.27 mm) may be machined on to or into an end of the shaft, depending on the shaft diameter, etc. Where a shaft diameter is too small to have a female feature while retaining integrity of surrounding material, a male feature may be utilized (e.g., where the shaft diameter is greater than that of the male feature).

As an example, an assembly can include a shaft that includes threads and a free end that includes a shaft drive feature; a compressor wheel that includes a compressor wheel drive feature and a through bore that receives the shaft; and a nut that includes threads that mate the threads of the shaft. In such an example, the assembly can include a collar disposed between a base of the compressor wheel and a portion of the shaft or another shaft such as, for example, a shoulder portion of the shaft or another shaft.

As an example, a nut can be utilized to apply a load to a compressor wheel where a portion of a shaft (e.g., a pilot portion or pilot section) disposed in the through bore of the compressor wheel is torsionless.

As an example, a shaft can include a shaft drive feature such as a TORX® drive feature. As an example, a shaft can include multiple shaft drive features (e.g., a female feature and a male feature where the female feature may be disposed in an end of a male feature, etc.).

As an example, a compressor wheel drive feature can include flats (e.g., flats in a polygonal arrangement suitable for being engaged by a tool such as, for example, a wrench).

As an example, a nut can include flats, for example, as a drive feature (e.g., flats in a polygonal arrangement suitable for being engaged by a tool such as, for example, a wrench).

As an example, a shaft drive feature can be a male feature such as, for example, a TORX® drive. As an example, a shaft drive feature can be a female feature such as, for example, a TORX® socket.

As an example, an assembly can include a shaft that includes threads and a free end that includes a shaft drive feature; a compressor wheel that includes a compressor wheel drive feature and a through bore that receives the shaft; and a nut that includes threads that mate the threads of the shaft where the shaft can include a turbine wheel attached thereto (e.g., welded, threaded, etc.).

As an example, an assembly can include a shaft that includes threads and a free end that includes a shaft drive feature; a compressor wheel that includes a compressor wheel drive feature and a through bore that receives the shaft; and a nut that includes threads that mate the threads of the shaft where an electric motor that is operatively coupled to the shaft (e.g., directly or indirectly).

As an example, an assembly can include two compressor wheels operatively coupled to one or more shafts. In such an example, an electric motor or electric motors may be operatively coupled to one or more of the one or more shafts.

As an example, a compressor wheel and shaft assembly can include a gear or wheel that may be, for example, gear and/or belt driven. For example, an internal combustion engine can include a crankshaft, a camshaft, etc. that is coupled to a gear and/or a belt such that a gear or wheel coupled to a compressor wheel and shaft assembly can be driven by rotation of the crankshaft, the camshaft, etc.

As an example, a method can include, for a compressor wheel and shaft assembly where the shaft includes threads and a free end that includes a shaft drive feature; a compressor wheel that includes a compressor wheel drive feature and a through bore that receives the shaft; and a nut that includes threads that mate the threads of the shaft, tightening the nut while preventing rotation of the shaft via the shaft drive feature and preventing rotation of the compressor wheel via the compressor wheel drive feature. In such an example, the method can include terminating the tightening and releasing torsion at the free end of the shaft.

As an example, a method can be performed where a base of a compressor wheel abuts a collar and where the collar abuts a shoulder of the shaft.

As an example, a method can include tightening that applies a tension to a portion of a shaft that is disposed in a through bore of a compressor wheel where, for example, the portion of the shaft is substantially torsionless.

Although some examples of methods, devices, systems, arrangements, etc., have been illustrated in the accompanying Drawings and described in the foregoing Detailed Description, it will be understood that the example embodiments disclosed are not limiting, but are capable of numerous rearrangements, modifications and substitutions.

What is claimed is:

1. An assembly comprising:

a shaft that comprises threads, defined by a thread diameter and an axial thread length, and a head portion that comprises a male shaft screw drive feature disposed over an axial length of the shaft between the threads and a free end of the shaft, wherein the male shaft screw drive feature comprises a male screw drive surface defined by a diameter that is less than the thread diameter;

a compressor wheel that comprises a hub that comprises a base and a nose, blades that extend radially outwardly from the hub, a through bore that extends through the hub between the base and the nose, and, adjacent to the nose, a compressor wheel drive feature that comprises flats, wherein the through bore receives the shaft, wherein the flats define a drive tool dimension; and a nut that comprises threads that mate the threads of the shaft, wherein the nut is tightenable against the nose of the compressor wheel to apply a load such that a portion of the shaft between an axial face of the shaft and the threads of the shaft is placed in tension with limited parasitic torsion while the male shaft screw drive feature is exposed, and wherein parasitic torsion of the head portion of the shaft is releasable via the exposed male shaft screw drive feature after reaching a desired load.

2. The assembly of claim 1 comprising a collar disposed between a shoulder of the shaft and the base of the compressor wheel.

3. The assembly of claim 2 wherein a portion of the shaft disposed in the through bore of the compressor wheel is torsionless.

4. The assembly of claim 1 wherein the male shaft screw drive feature comprises a plurality of lobes.

5. The assembly of claim 1 wherein the nut comprises flats.

6. The assembly of claim 1 wherein the shaft comprises a turbine wheel.

7. The assembly of claim 1 comprising an electric motor that is operatively coupled to the shaft.

8. The assembly of claim 1 comprising two compressor wheels operatively coupled to the shaft.

9. A method comprising:

for a compressor wheel and shaft assembly wherein the shaft comprises threads and a free end that comprises a shaft screw drive feature wherein the shaft screw drive feature comprises a male screw drive surface or a female screw drive socket that correspond to a first drive tool; wherein the compressor wheel comprises a hub that comprises a base and a nose, blades that extend radially outwardly from the hub, a through bore that extends through the hub between the base and the nose, and, adjacent to the nose, a compressor wheel drive feature that comprises flats, wherein the through bore receives the shaft, and wherein the flats define a drive tool dimension of a second drive tool; and wherein a nut comprises threads that mate the threads of the shaft, tightening the nut while preventing rotation of the shaft via the shaft screw drive feature being mated with the first drive tool and preventing rotation of the compressor wheel via the compressor wheel drive feature being mated with the second drive tool and terminating the tightening and releasing parasitic torsion at the free end of the shaft via the shaft screw drive feature.

10. The method of claim 9 wherein the base of the compressor wheel abuts a collar and wherein the collar abuts a shoulder of the shaft.

11. The method of claim 9 wherein the tightening applies a tension to a portion of the shaft that is disposed in the through bore of the compressor wheel.

12. The method of claim 11 wherein the portion of the shaft is with limited parasitic torsion.

13. An assembly comprising:

a shaft that comprises threads and a free end that comprises a shaft screw drive feature at a head portion of the shaft, wherein the shaft screw drive feature comprises a female feature that comprises a female screw drive socket;

a compressor wheel that comprises a hub that comprises a base and a nose, blades that extend radially outwardly from the hub, a through bore that extends through the hub between the base and the nose, and, adjacent to the nose, a compressor wheel drive feature that comprises flats, wherein the through bore that receives the shaft, wherein the flats define a drive tool dimension; and a nut that comprises threads that mate the threads of the shaft, wherein the nut is tightenable against the compressor wheel to apply a load such that a portion of the shaft between an axial face of the shaft and the threads of the shaft is placed in tension with limited parasitic torsion, and wherein parasitic torsion of the head portion of the shaft is releasable via the female screw drive socket after reaching a desired load.

14. The assembly of claim 13 wherein the female feature comprises a screw drive socket that comprises a plurality of lobes.

15. The assembly of claim 13 comprising a collar disposed between a shoulder of the shaft and the base of the compressor wheel.

16. The assembly of claim 15 wherein a portion of the shaft disposed in the through bore of the compressor wheel is torsionless.

17. The assembly of claim 13 wherein the nut comprises flats.

18. The assembly of claim 13 wherein the shaft comprises a turbine wheel.

19. The assembly of claim 13 comprising an electric motor that is operatively coupled to the shaft.

20. The assembly of claim 13 comprising two compressor wheels operatively coupled to the shaft.

* * * * *